United States Patent [19]

Marquardt

[11] Patent Number: 4,479,117

[45] Date of Patent: Oct. 23, 1984

[54] ADD-ON STATE INDICATOR FOR AN ENCLOSED D.C. POWER RELAY

[75] Inventor: Walter L. Marquardt, Menomonee Falls, Wis.

[73] Assignee: Eaton Corporation, Cleveland, Ohio

[21] Appl. No.: 423,396

[22] Filed: Sep. 24, 1982

[51] Int. Cl.[3] ..... G08B 21/00

[52] U.S. Cl. ..... 340/644; 307/116; 335/2; 335/151; 340/653; 340/654

[58] Field of Search ..... 340/644, 638, 654, 653; 335/2, 151, 152, 153, 154, 193; 361/210, 189, 190; 307/116, 157

[56] References Cited

U.S. PATENT DOCUMENTS

| | | | |
|---|---|---|---|
| 3,254,171 | 5/1966 | Freeland et al. | 335/152 |
| 3,256,425 | 6/1966 | Deeg | 361/210 X |
| 3,312,967 | 4/1967 | Levine | 340/635 |
| 3,355,629 | 11/1967 | Schapira | 335/193 |
| 3,644,886 | 2/1972 | Sabaroff | 335/154 X |
| 3,979,705 | 9/1976 | Hayden | 335/151 |
| 4,293,131 | 10/1981 | Fellman et al. | 335/151 X |

FOREIGN PATENT DOCUMENTS

| | | | |
|---|---|---|---|
| 1152426 | 5/1969 | United Kingdom | 335/151 |

*Primary Examiner*—James L. Rowland
*Assistant Examiner*—Daniel Myer
*Attorney, Agent, or Firm*—W. A. Autio; C. H. Grace

[57] ABSTRACT

An add-on fault indicator comprising a magnetic reed switch (22) and a lamp (24) connected in series across relay contacts (10, 12, 14) with the reed switch mounted by a clamp (34) contiguous to the outer surface of the metal coil shell (6) so as to be closed by the magnetic field when the coil (2) is energized. A normal operation indicator lamp (26) is connected in series with the relay contacts to indicate closure of the latter to energize a load (20). Fault indicator lamp (24) lights if the contacts do not close when the coil is energized but is shunted by the contacts to remain unlighted when the contacts close properly.

7 Claims, 2 Drawing Figures

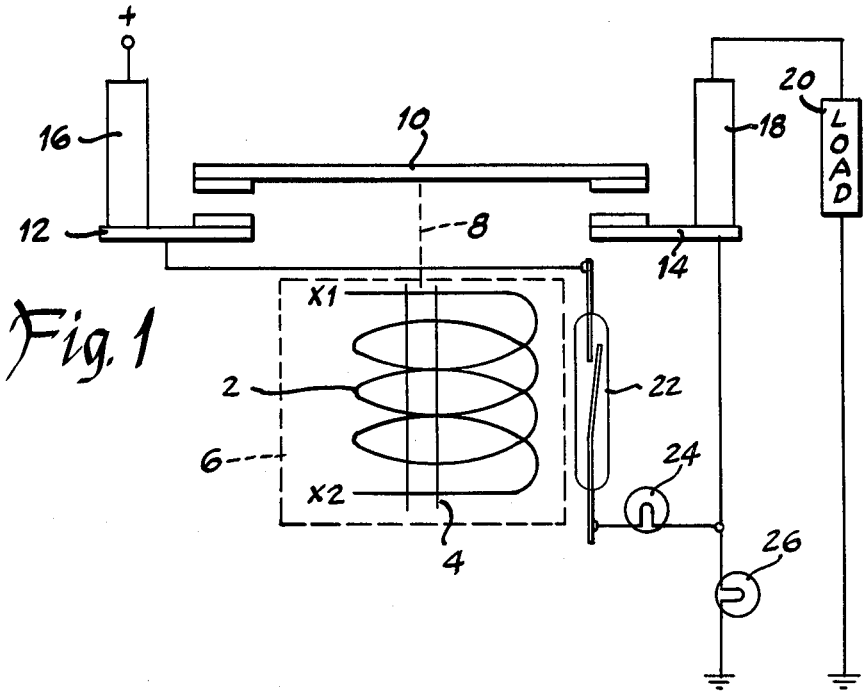
Fig. 1
Fig. 2
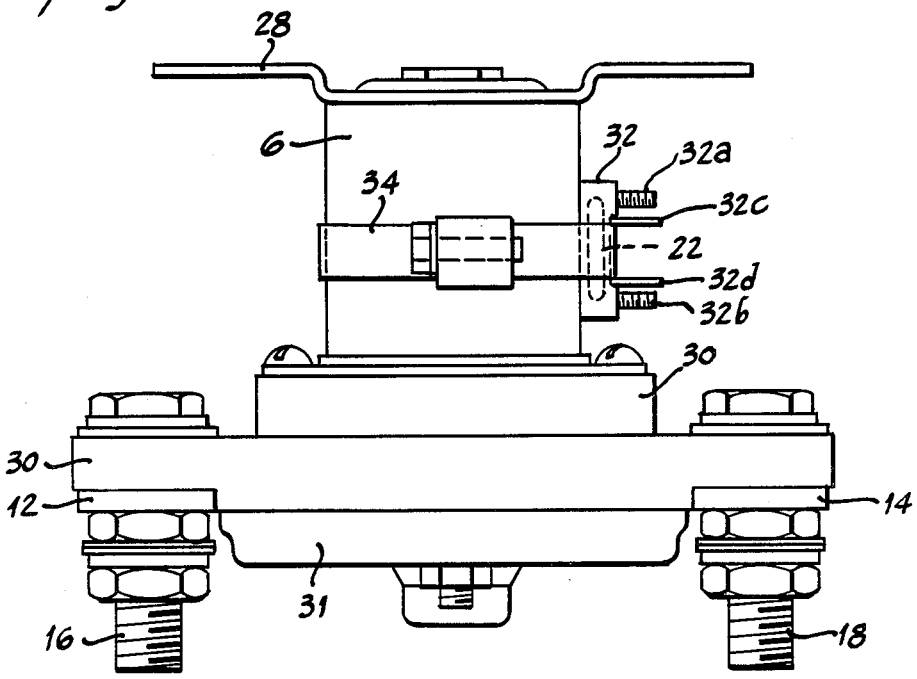

ADD-ON STATE INDICATOR FOR AN ENCLOSED D.C. POWER RELAY

BACKGROUND OF THE INVENTION

Pilot light circuits for monitoring the open and closed states of switches or contacts have been known heretofore. For example, M. R. Lavelle, U.S. Pat. No. 3,696,364, dated Oct. 3, 1972, shows a circuit for monitoring the state of an alternating current relay and includes a full-wave rectifier, a capacitor, a neon lamp, a light-actuated silicon controlled rectifier, an indicator lamp and a separate low voltage source. While monitoring circuits of that type have been useful for their intended purpose, they have, nevertheless, been handicapped not only by their complexity and difficulty of mounting the large number of components but also by the fact that they monitor only the closed-open state of the switch or contact and do not give any indication as to the state of the device that operates the contact such as an electromagnetic coil. It has, therefore, been found desirable to provide an improved relay state indicator.

SUMMARY OF THE INVENTION

An object of the invention is to provide an improved state indicator for an enclosed D.C. power relay.

A more specific object of the invention is to provide an improved add-on state indicator for an enclosed relay.

Another specific object of the invention is to provide improved means for operatively mounting one or more magnetic reed switches for auxiliary use on the coil shell of a D.C. power relay.

A further specific object of the invention is to provide a simple and economical monitoring device that may be added to a relay after it has been assembled.

Other objects and advantages of the invention will hereinafter appear.

BRIEF DESCRIPTION OF THE DRAWINGS

FIG. 1 is a schematic circuit diagram of an add-on state indicator for an enclosed D.C. power relay constructed in accordance with the invention; and FIG. 2 is an elevational view of a D.C. power relay showing the reed switch of FIG. 1 mounted thereon.

DESCRIPTION OF THE PREFERRED EMBODIMENT

As shown in FIG. 1, there is shown an add-on state indicator for an enclosed D.C. power relay constructed in accordance with the invention. As shown therein, the relay is provided with an electromagnet comprising a coil 2 surrounding an iron core 4 which are enclosed in a housing such as a coil shell 6 of metal or the like. As indicated by broken line 8 in FIG. 1, this electromagnet is arranged to operate a bridging contact 10 which, when closed, bridges a pair of stationary contacts 12 and 14 to complete a circuit from the positive side of a D.C. power supply through terminals 16 and 18 and load 20 to ground. A magnetic reed switch 22 and a fault indicator lamp 24 are connected in series between stationary contacts 12 and 14 or, on the other hand, these connections may be made to terminals 16 and 18. A normal operation indicator lamp 26 is connected from stationary contact 14 to ground.

The circuit in FIG. 1 operates as follows. Under normal conditions, when the coil is energized by connecting electric power to its terminals X1 and X2, reed switch 22 and contact 10 close almost simultaneously so that fault indicator lamp 24 does not light because it is shunted by the relay contacts. As soon as the relay contacts close normal operation lamp 26 lights to indicate the normal operation.

On the other hand, if there should be a fault such that the relay power contacts do not close sufficiently to complete a circuit therethrough, due to weld or other contamination of the contacts, reed switch 22 closes immediately upon energization of the relay coil and lights fault indicator lamp 24. The circuit for lamp 24 extends from the positive side of the D.C. supply through terminal 16, stationary contact 12, reed switch 22, lamp 24, stationary contact 14, terminal 18 and load 20 to ground. The resistance of load 20 is sufficiently smaller than the resistance of lamp 26 so that lamp 26 does not light under these conditions. Alternatively, depending upon the relative resistances of the load and lamp 26, lamp 26 may be arranged to light to a dim state under these fault conditions. As a result, fault indicator lamp 24 indicates that there is a fault in the system inasmuch as the coil is energized but the contacts have not completed an electrical circuit therethrough.

FIG. 2 shows a conventional D.C. power relay onto which the reed switch 22 of FIG. 1 is mounted. This relay comprises a mounting plate 28 at its upper portion attached to coil shell 6. This coil shell 6 is attached to an electrically insulating base 30 onto which are mounted stationary contacts 12 and 14 that extend from terminals 16 and 18, respectively, within cover 32. The coil within coil shell 6 surrounds a magnetic core and a spring biased movable armature connected to the movable bridging contact within cover 32. Since D.C. power relays of this type are well known, it has been shown only schematically in FIG. 2 in order to illustrate how the reed switch is mounted thereon. The reed switch 22 is preferably embedded within an electrically insulating, plastic block 32 or the like with the terminals at the opposite ends thereof electrically connected to a pair of threaded terminal posts **32*a* and 32*b* that extend laterally out from the insulating block 32. This insulating block 32 which is preferably molded may also be provided with a pair of integrally molded insulating flanges or walls 32*c* and 32*d* inwardly of the thermal post to insulate these thermal posts from the reed switch mounting means which may be metal or the like as hereinafter described. The back of this insulating block 32 may be given a curvature complementary to the curvature of cylindrical coil shell 6 so that the reed switch therewithin may be placed into close proximity to shell 6 and the electromagnetic coil therewithin. An ordinary metal clamp 34 is then placed around the coil shell and between walls 32*c* and 32*d* of insulating block 32 and the screw 34*a* turned to tighten the clamp and thereby securely clamp the reed switch to the relay. While only the reed switch has been shown clamped to the coil shell in FIG. 2**, it will be apparent that more than one similar reed switch may be clamped thereto for use for auxiliary switching purposes. While the invention has been illustrated and described as an add-on state indicator, it will be apparent that the reed switch can be built into the relay within the coil shell.

While the apparatus hereinbefore described is effectively adapted to fulfill the objects stated, it is to be understood that the invention is not intended to be confined to the particular preferred embodiment of add-on state indicator for an enclosed D.C. power relay disclosed, inasmuch as it is susceptible of various modifications without departing from the scope of the appended claims.

I claim:

1. An operating condition indicating enclosed relay having an electromagnet including a coil for operating contacts and a housing enclosing said electromagnet and its coil and said contacts and external terminals for connecting said relay in an electric power supply circuit comprising in combination therewith of:

an electrically energizable indicator;

means connecting said indicator acoss said contacts so as to be shunted and deenergized when said contacts close;

a magnetic field operated circuit closing means;

means mounting said circuit closing means to said coil housing; and means connecting said circuit closing means in circuit with said indicator so as to be closed by the magnetic field of said electromagnet when said coil is energized to energize said indicator in the event said contacts do not close although said coil is energized thereby to indicate said coil energization together with failure of said contacts to close.

2. The operating condition indicating enclosed relay claimed in claim 1, wherein:

said circuit closing means is a magnetic switch having contacts closed by the magnetic field of the energized coil outside said coil housing.

3. The operating condition indicating enclosed relay claimed in claim 2, wherein:

said magnetic switch is a glass-enclosed magnetic reed switch having terminals extending through the glass enclosure.

4. The operating condition indicating enclosed relay claimed in claim 3, wherein:

said reed switch is embedded within a molded insulating base with said reed switch terminals extending to the exterior of said base;

and said mounting means comprises a clamp surrounding said coil housing and said reed switch base to clamp said reed switch into close proximity to said coil housing.

5. The operating condition indicating enclosed relay claimed in claim 4, wherein:

said molded base comprises integrally molded walls between said switch terminals and said clamp.

6. An operating condition indicating self-enclosed relay having an electromagnet including an operating coil for operating contacts and a housing therefore including a metal coil shell with external terminals on said housing for connecting said contacts in an electirc power supply circuit for energizing a load comprising in combination therewith of:

a fault indicator connected across said contacts so as to be energized when said relay is energized if said contacts do not close and to be shunted and deenergized when said contacts close;

and a magnetic switch and means mounting said switch to said coil shell and being connected in circuit with said indicator so as to be closed by the magnetic field of said coil upon energization to energize said indicator in the event said contacts do not close a shunt thereacross although said coil is energized thereby to indicate said coil energization together with failure of said contacts to compete a circuit therethrough.

7. The operating condition indicating self-enclosed relay claimed in claim 6, wherein:

said operating condition indicating self-enclosed relay also comprises a normal operation indicator connected in series with said contacts to said electric power supply circuit to indicate normal operation of said contacts upon closure thereof.

* * * * *